US007517119B2

(12) United States Patent
Kaeser et al.

(10) Patent No.: US 7,517,119 B2
(45) Date of Patent: Apr. 14, 2009

(54) EXTERNALLY ADJUSTABLE DIRECTIONAL LUMINAIRE

(75) Inventors: Robert E. Kaeser, Cincinnati, OH (US); James E. Lawrence, Madeira, OH (US); Michael D. Wyatt, Hamilton, OH (US)

(73) Assignee: LSI Industries, Inc., Cincinnati, OH (US)

( * ) Notice: Subject to any disclaimer, the term of this patent is extended or adjusted under 35 U.S.C. 154(b) by 156 days.

(21) Appl. No.: 11/560,132

(22) Filed: Nov. 15, 2006

(65) Prior Publication Data

US 2007/0109799 A1 May 17, 2007

Related U.S. Application Data

(60) Provisional application No. 60/737,304, filed on Nov. 16, 2005.

(51) Int. Cl.
*F21S 8/00* (2006.01)

(52) U.S. Cl. ..... 362/427; 362/428; 362/153; 362/429; 362/269; 362/372; 362/282; 362/364; 362/365

(58) Field of Classification Search ..... 362/427, 362/428, 153, 429, 269, 372, 282, 287, 364, 362/365, 374–378
See application file for complete search history.

(56) References Cited

U.S. PATENT DOCUMENTS 3,949,215 A 4/1976 Whitney
4,075,470 A 2/1978 Moore
4,217,629 A 8/1980 Russell
4,217,631 A 8/1980 Bergkvist
4,420,798 A 12/1983 Herst et al.
4,470,106 A 9/1984 Norton
4,473,873 A 9/1984 Quiogue
4,639,843 A 1/1987 Compton
5,609,408 A 3/1997 Targetti
5,613,766 A * 3/1997 Raouf ..... 362/287
5,800,050 A 9/1998 Leadford
6,505,960 B2 1/2003 Schubert et al.
6,612,720 B1 9/2003 Beadle
6,779,908 B1 8/2004 Ng
6,802,627 B2 10/2004 Fischer et al.
6,874,917 B2 4/2005 Spada
2004/0124792 A1 * 7/2004 Fischer et al. ..... 315/362

* cited by examiner

*Primary Examiner*—Stephen F Husar
*Assistant Examiner*—Jessica L McMillan
(74) *Attorney, Agent, or Firm*—Hasse & Nesbitt LLC; Daniel F. Nesbitt

(57) ABSTRACT

An externally adjustable directional canopy luminaire is disclosed that may be easily and quickly adjusted from the outside of its housing to direct light toward a particular target area. The luminaire includes a lamp shroud assembly including a door frame, a shroud and a lamp socket which is connectable to an electrical power source to power a replaceable lamp, an external adjustment member, and an internal mechanism movably connected to the external adjustment member through the shroud and indirectly connected to a portion of the lamp socket, wherein adjustment of the external adjustment member can alter the angle of direction of the lamp socket and thus the direction of light emitted from the replaceable lamp through the opening of the shroud.

17 Claims, 6 Drawing Sheets

EXTERNALLY ADJUSTABLE DIRECTIONAL LUMINAIRE

CROSS REFERENCE TO RELATED APPLICATION

The present application claims the benefit of co-pending U.S. provisional patent application 60/737,304, filed Nov. 16, 2005.

FIELD OF THE INVENTION

This invention relates generally to luminaires and more particularly to luminaires adapted to direct light in a desired direction.

BACKGROUND OF THE INVENTION

Luminaires are used in many commercial and consumer venues to illuminate particular areas of a site, such as lighting for a service station, storefront or restaurant, and are typically mounted on or within a support structure such as a ceiling, canopy structure or building exterior.

Luminaires of currently existing designs are typically mounted on their support structures either by direct attachment to the structure or by creating an opening and installing the recessed luminaire into the opening. A typical drawback associated with many existing luminaires is that the lamp is mounted in a fixed position on or within the support structure, thereby prohibiting redirection of the light emanating from the lamp toward specific, desired areas below. Although lenses can be used to direct the light toward a particular area and focus the light output downward, a substantial portion of the luminous output of the lamp is nevertheless emitted in other directions.

Some existing luminaires permit movement of the luminaire body to direct the light output, most notably track lighting. However, such existing luminaires are not designed to withstand outside environments, such as weather and insects. Further, many have limitations in the rotational range of the lamps and cannot be easily locked into place. U.S. Pat. No. 6,802,627 to Fischer ("the '627 patent") discloses an adjustable canopy luminaire capable of withstanding outdoor use. However, the luminaire of the '627 patent can only be tilted to a fixed predetermined angle relative to the opening by opening the door of the luminaire and then lifting and placing the lamp edge on tabs that are located within the housing. Thus, the luminaire of the '627 patent provides only a limited number of angles for aiming the lamp, and it is not possible to adjust the lamp from the outside of the housing.

Another common problem with canopy luminaires is the amount of electricity consumed by the lamp and the complexity of the lamp's electrical system. While a variety of types of lighting lamps can be used, including common fluorescent and incandescent lamps, luminaires in commercial applications often use high intensity discharge (HID) lamps to provide the desired level of lighting. The use of HID light sources can have many drawbacks. HID light sources are regulated by control gear, which may include a ballast alone or in combination with other components such as capacitors, igniters, or other such equipment. This control gear may be as large as or larger than the lamp itself. Further, the lamp and control gear are frequently contained within a box-like housing, which must be mounted to the support structure. HID light sources also use more electricity than lighting alternatives.

One other drawback associated with existing canopy luminaires, again relating to the difficulty in directing the light output toward the intended area, involves the need for using a larger lamp, such as a HID lamp, to provide the desired level of lighting. As the lens cannot efficiently direct the high intensity light to specific areas, much of the light is scattered toward unintended local and distant destinations. This scattering results in light pollution issues ranging from the disturbance of neighbors to interference of night sky viewing.

Thus, there is a substantial need for a luminaire that has increased adjustability over the prior art. It would also be advantageous to provide an externally adjustable luminaire that is easily and quickly adjusted from the outside of the luminaire housing. It would also be advantageous to provide an externally adjustable luminaire that can be aimed through its opening in an infinite number of angles and directions. There also exists a substantial need for a luminaire that may be easily and quickly adjusted to direct light toward a particular target area without scattering light to unintended areas. Further, there is a significant need for a luminaire that is capable of using a smaller lamp and consuming less electricity in its operation while providing the same degree of illumination.

SUMMARY OF THE INVENTION

The present invention provides a luminaire which overcomes drawbacks associated with the currently existing luminaires. More specifically, one aspect of the present invention is an adjustment mechanism for directing the emitted light from a lamp of a luminaire, the luminaire comprising a luminaire support structure; a door frame attached to the structure; a lamp shroud assembly comprising a shroud rotatably attached to the door frame and having an opening, and a lamp socket sized to receive the base of a replaceable lamp and electrically connectable to an electric power source, the adjustment mechanism comprising a movable external adjustment member and an internal mechanism attached to the external adjustment member through the shroud and indirectly connected to a portion of the lamp socket, the internal mechanism being movable in response to movement of the external adjustment member, wherein movement of the external adjustment member can change the angle of direction of light emitted from the replaceable lamp through the opening of the shroud.

Another aspect of the present invention is an externally adjustable directional luminaire comprising a luminaire support structure; a door frame attached to the structure; a lamp shroud assembly comprising a shroud rotatably attached to the door frame and having an opening, and a lamp socket sized to receive the base of a replaceable lamp and electrically connectable to an electric power source; an external adjustment member located on the outside surface of the shroud; and an internal mechanism movably connected to the external adjustment member through the shroud at one end and connected to the lamp socket at another end, the internal mechanism being movable in response to movement of the external adjustment member, wherein movement of the external adjustment member alters the angle of direction of light emitted from the replaceable lamp through the opening of the shroud.

In the various embodiments of the present invention, the lamp socket and the lamp are typically directed toward the opening of the shroud, and the opening is typically not perpendicular to the support structure, although it can be perpendicular thereto. Further, the rim edge of the shroud is typically formed with a projection to limit rotation of the shroud within the door frame to a maximum of a single revolution. Still further, the opening of the shroud can be covered by a lens.

The internal mechanism typically comprises a non-rotatable adjustment brace to receive the external adjustment member, a lever connected to the non-rotatable adjustment brace by a brace pin, a fulcrum mounted on the inner wall of the shroud and connected to the lever by a fulcrum pin, at least one mounting bracket connected to the lever by a bracket pin, a directional lamp harness mounted to the light supporting means and connected to the at least one mounting bracket by a bracket connector, and an internal support base mounted proximate the opening of the shroud and connected to the directional harness by a harness connector.

In one embodiment, the external adjustment member can be a threaded member, such as a bolt, rotatably received by a portion of the internal mechanism, whereby rotation of the threaded member is operable to cause the internal mechanism to move the lamp socket. The movement of the lamp socket by the internal mechanism can be with or without a mechanical advantage. In a particular embodiment, the external adjustment member can comprise a turnbuckle assembly, whereby screwing and unscrewing of the external adjustment member is operable to cause the internal mechanism to move the lamp socket.

In yet another embodiment, the external adjustment member can be a handle, wherein the internal mechanism comprises a rod connected to the handle at a first end and pivotally connected to the lamp socket at a second end, whereby pushing and pulling of the handle causes the internal mechanism to move the lamp socket.

The nature and advantages of the present invention will be more fully appreciated from the following drawings, detailed description, and appending claims.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

Figure 1:
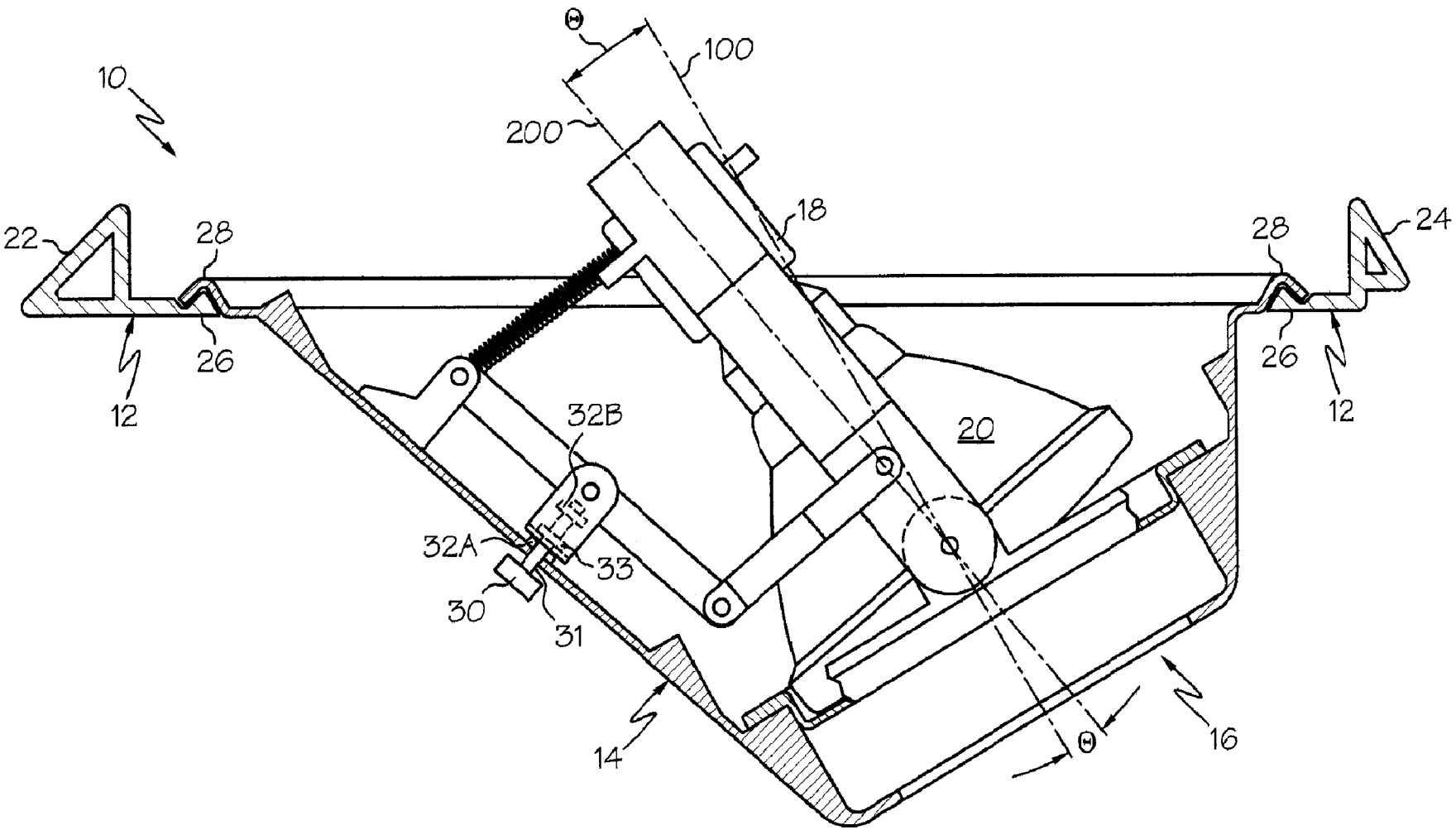
FIG. 1 is a partial cross-sectional side view of one embodiment of the lamp shroud assembly and door of the present invention.

The externally adjustable directional luminaire 10, as depicted in FIG. 1, comprises a door frame 12, a rotatable shroud 14 having an opening 16, and a lamp socket 18 associated with the shroud and sized to receive the base of a replaceable lamp 20. The door frame 12 comprises at least one hinge 22 at one end, a clamp bar 24 at the other end, and a retaining lip 26 which defines a hole in the door 12. The shroud 14 comprises a rim edge 28 that is of substantially similar dimension to the retaining lip 26 of the door frame 12. The rim edge 28 of the shroud 14 extends over and is received by the retaining lip 26 of the door frame 12, thereby securing and permitting rotation of the shroud 14 within the door frame 12. The lamp 20 can be adjusted externally by turning an external adjustment member 30, which includes an elongated shaft 31 that cooperates with an internal mechanism to move the lamp socket 18 and lamp 20 along line 200 at an angle θ relative to the central axis 100 of the opening 16 of the shroud 14. The lamp 20 as shown is a reflector type or PAR lamp, but could be any type of lamp, including a HID, fluorescent or incandescent lamp associated with a separate reflector to direct the light along axis 200.

Figure 2:
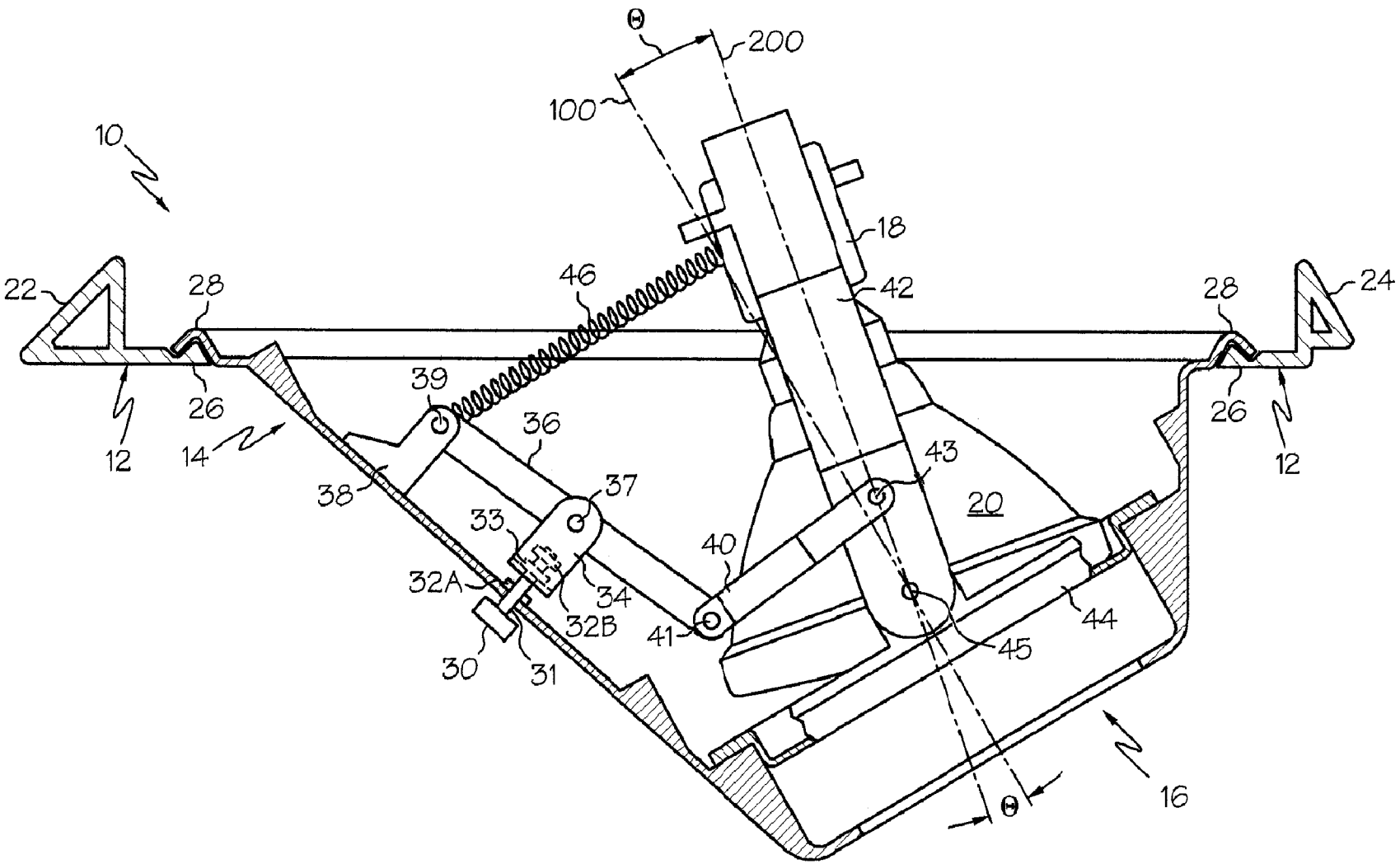
FIG. 2 is a partial cross-sectional side view of the lamp shroud assembly and door of FIG. 1 after external adjustment of the lamp.

Looking now at FIG. 2, the external adjustment member 30 including the elongated threaded shaft 31 is rotatably secured to the shroud 14 at a first end by a first securing means 32A. Threaded shaft 31 is threadably attached to a non-rotatable securing means 33 and a non-rotatable adjustment brace 34, and is prevented from being threadably separated from the non-rotatable adjustment brace 34 at a second end by a second securing means 32B. A lever 36 is pivotally connected near its mid-point to the non-rotatable adjustment brace 34 by brace pin 37. Fulcrum 38, mounted on the inner wall of the shroud 14, is pivotally connected to one end of the lever 36 by fulcrum pin 39, and a mounting bracket 40 is pivotally connected to the other end of the lever 36 by bracket pin 41. A directional lamp harness 42 is mounted over the lamp socket 18 and lamp 20 and is pivotally connected at a position along its length to the mounting bracket 40 by bracket connector 43. An internal support base 44 is mounted proximate the opening 16 of the shroud 14 and is pivotally connected to the proximal end of the directional harness 42 by harness connector 45. A spring 46 extends from the fulcrum 38 to the distal end of the lamp harness 42, and serves to stabilize the lamp 20 as it assumes its various positions within the shroud 14.

It can be appreciated from FIG. 2 that the lamp 20, which was aimed to direct light out of the opening 16 of the shroud 14 along line 200 and at an angle θ from the axis 100 of the shroud 14 in FIG. 1, is now aimed to direct light out of opening 16 along line 200 and at a different angle θ from the axis 100 of the shroud 14 in FIG. 2. This change in the angle θ is accomplished by external manipulation of the adjustment member 30 by a user. In practice, the shaft 31 of adjustment member 30 acts directly upon the non-rotatable adjustment brace 34, which is part of an internal mechanism, whereby rotation of the external adjustment member 30 causes the shaft 31 to be screwed into or out of (depending upon which direction one turns) the non-rotatable adjustment brace 34, starting a chain of events which ultimately moves the replaceable lamp 20 through angle θ with a mechanical advantage. More specifically, as the shaft 31 is screwed out of the securing means 33 of the non-rotatable brace 34, lever 36 is pushed in an inward direction away from the shroud 14. Lever 36 then causes mounting bracket 40 to pivot about bracket pin 41. Mounting bracket 40, connected to the directional lamp harness 42 via bracket connector 43, pivots about the harness connector 45, which is stationary and connected to the stationary internal support base 44.

Thus, internal support base 44 acts as a fulcrum for the harness 42, and since the harness 42 is rigidly secured to the lamp socket 18, then the lamp socket 18 (and also the lamp 20) will move with the harness 42 as it pivots about the support base 44. A mechanical distance advantage is gained because a relatively short distance of movement of the non-rotatable securing means 33 and adjustment brace 34 along the shaft 31 results in a larger distance of movement of the mounting bracket 40, and in turn, the distance of movement of the bracket connector 43 results in an even larger distance of movement of the socket 18. Therefore, the lamp socket 18 and lamp 20 are caused to move a relatively large distance (through angle θ) upon movement of the external adjustment member 30 a short distance, resulting in a mechanical advantage. Thus, the lamp 20 can be aimed along an infinite amount of lines 200 at an angle θ from the axis 100 of the shroud 14, and a user can easily adjust the vertical direction of the light coming from the luminaire from outside the housing of the luminaire. Typically the angle θ can be altered by a user from between about −35° to about +35°, more typically from between about −20° to about +20°, relative to the axis 100 of the shroud.

Figure 3:
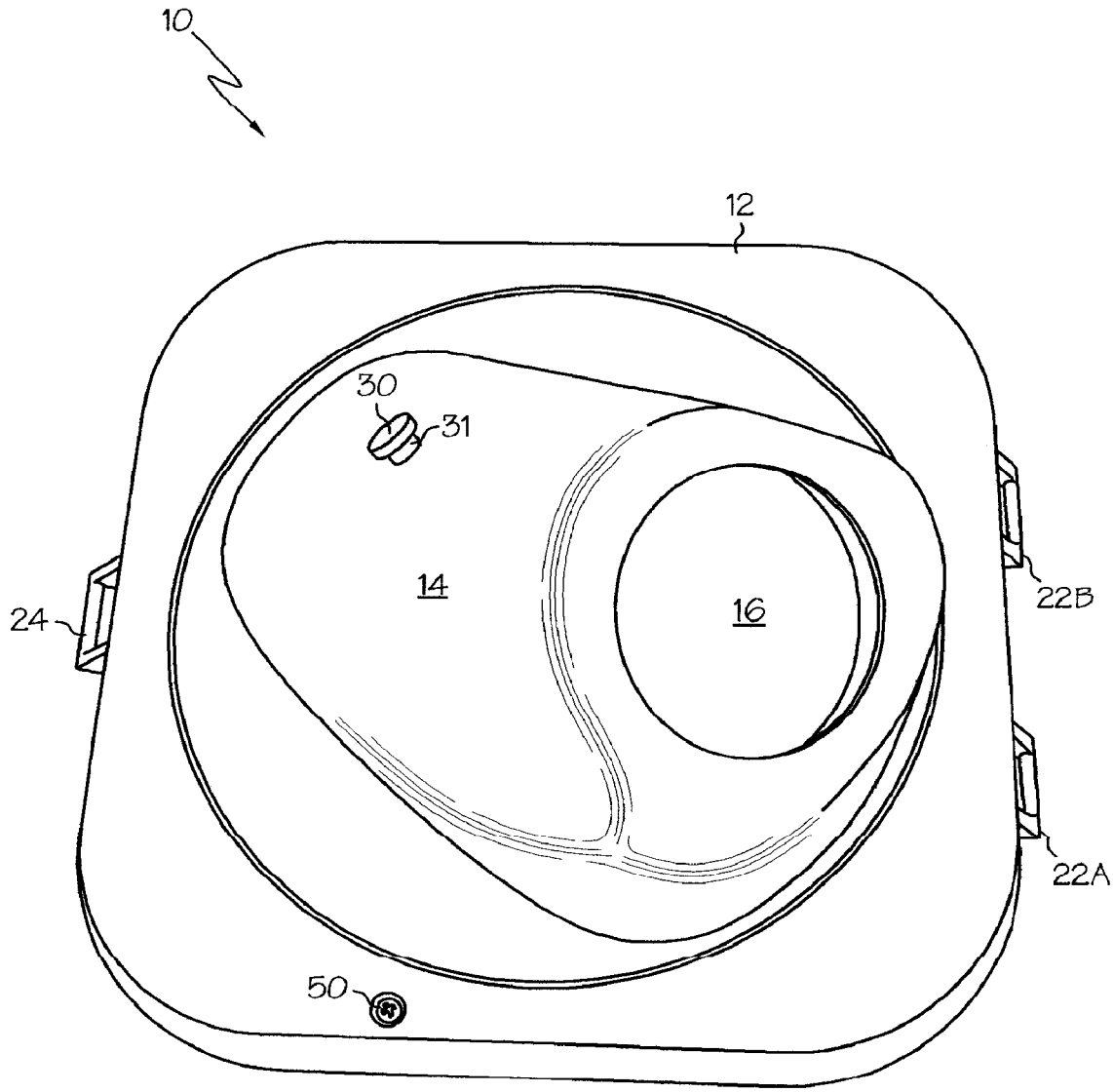
FIG. 3 is a bottom perspective view of one embodiment of the lamp shroud assembly and door of the present invention.

FIG. 3 illustrates a bottom perspective view of one embodiment of the luminaire 10 of the present invention, showing the door 12, the shroud 14 with its opening 16, hinges 22A and 22B at one end, the clamp bar 24 at the other end, external adjustment member 30 housing the elongated shaft 31 on the outside of shroud 14, and a securement 50 on the outside of the door 12. The securement, shown as screw 50, whose function will be explained in more detail below, is tightened or loosened as desired in order to restrict or allow rotation of the shroud 14 within the door 12. It can be appreciated from viewing FIG. 3 that the external adjustment member 30 and screw 50 are both accessible to a user from the outside of the shroud 14. Thus, the door 12 docs not need to be opened in order to adjust the vertical direction of light coming from the opening 16, or to adjust the horizontal direction in which the opening 16 of the shroud 14 is aimed, in relation to the door 12.

Figure 4:
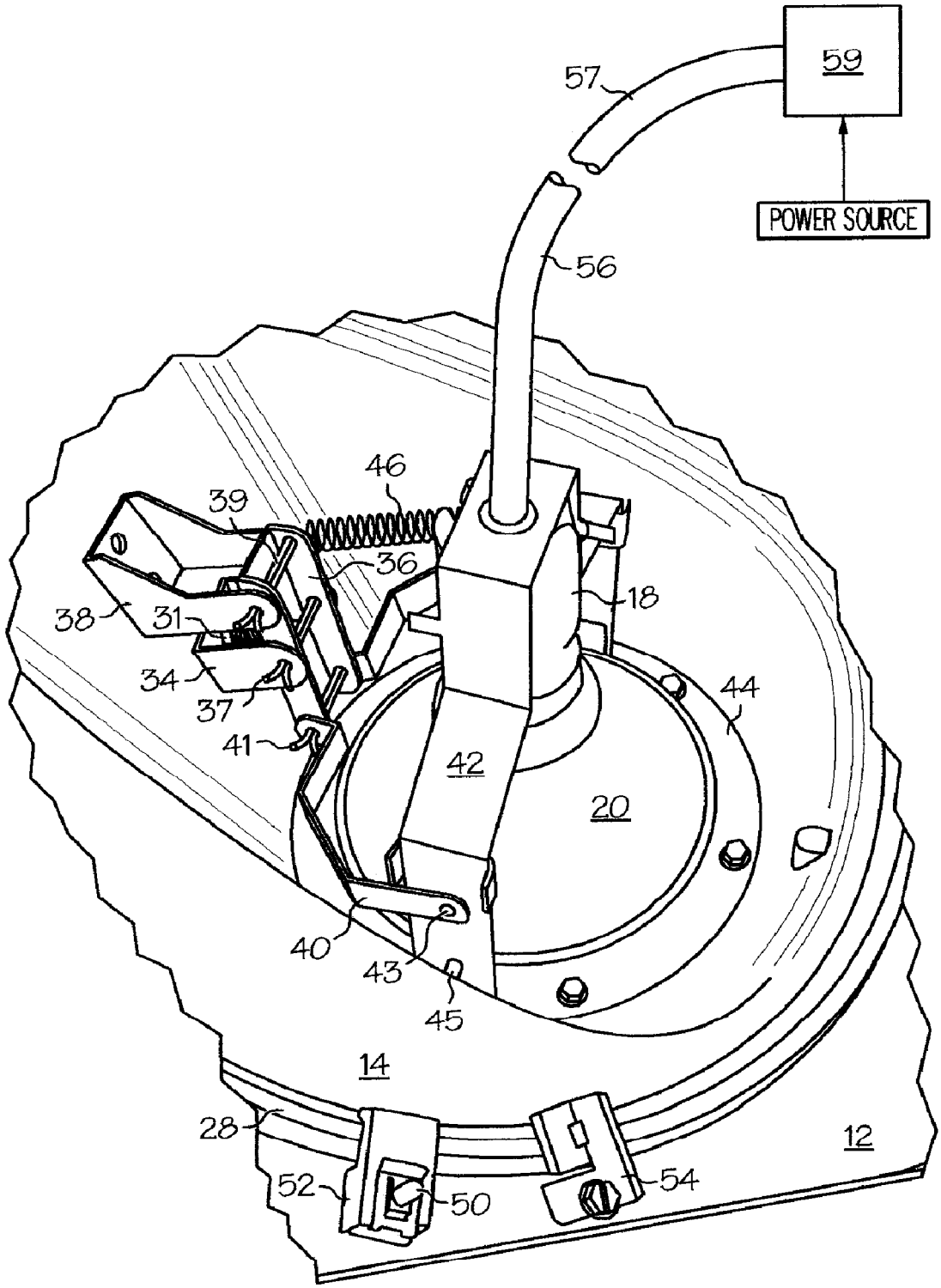
FIG. 4 is a perspective view of a lamp as it sits within the lamp shroud assembly and door.

FIG. 4 is a perspective view of the lamp socket 18 and lamp 20 as they associate with the shroud 14. The non-rotatable adjustment brace 34 can be seen as it receives the external adjustment member 30. The directional lamp harness 42 is mounted over the lamp socket 18 and lamp 20, and connected to the mounting bracket 40 by bracket connector 43 and to the internal support base 44 by harness connector 45. Electrical wiring 56 exits the top of the lamp socket 18 and passes through the lamp harness 42 on its way to a connection (not shown) with second electrical wiring 57. Second electrical wiring 57 is received by a second socket 59, which is connected to a power source. Spring 46 extends from the fulcrum 38 to the distal end of the lamp harness 42, and serves to stabilize the lamp 20 as it assumes its various positions within the shroud 14. A top clamp 52 contacts the rim edge 28 of the shroud. Securement or screw 50 extends from beneath the door frame 12 and is threaded through an opening in the top clamp 52. Upon tightening of the screw 50, the top clamp 52 presses the shroud 14 and the door frame 12 together and frictionally restricts rotational movement of the coupled shroud 14 and door frame 12. A plurality of guides 54 are secured with a screw into the door frame 12, and flexibly contact the rim edge 28 to stabilize the movement of the shroud 14 as it rotates about the retaining lip 26 of the door frame 12.

Figure 5:
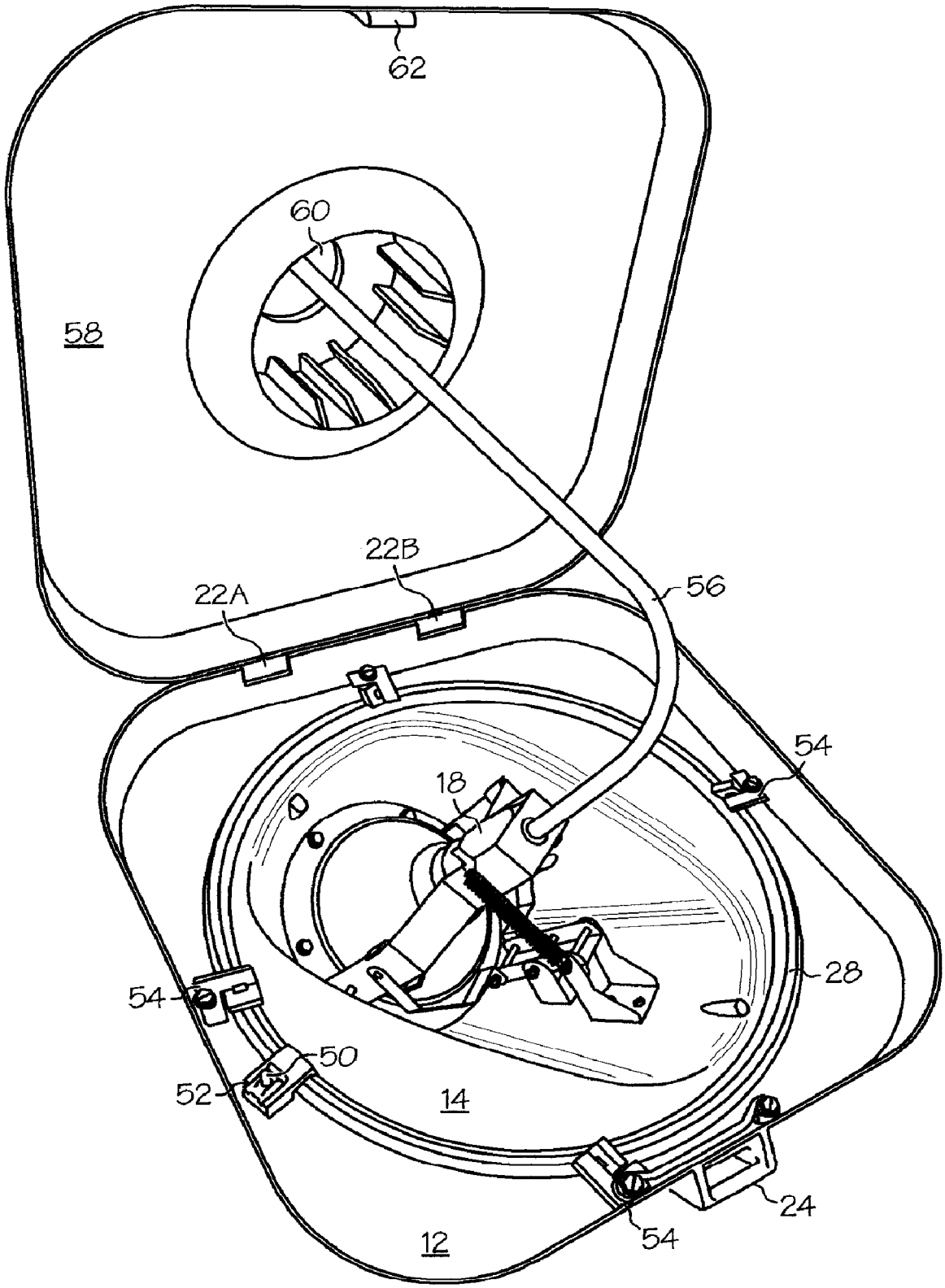
FIG. 5 is a top perspective view of the door frame and shroud in an open position away from the luminaire support structure.

As illustrated in FIG. 5, the directional luminaire assembly is shown coupled with a luminaire housing structure 58. Electrical wiring 56 exits the lamp socket 18 and passes through a housing opening 60 and is connected to the electrical power source, accessible through the housing opening 60. The luminaire is connected to the housing structure 58 via hinges 22A, 22B on one end and a flexible clamp mechanism on the other end, including a receiving flexible clamp 62 and the clamp bar 24 that fits into and is held by the clamp 62.

Figure 6:
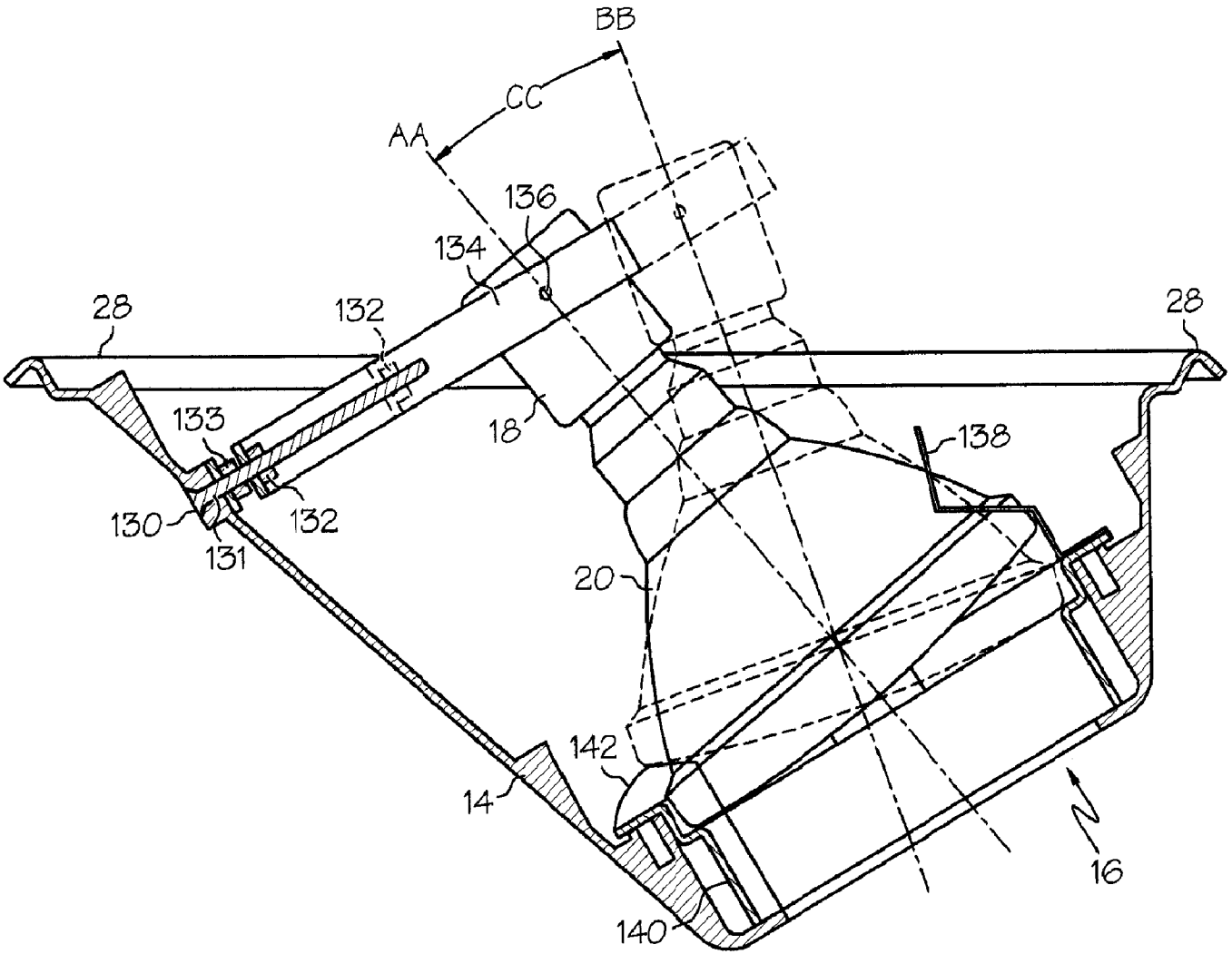
FIG. 6 is a partial cross-sectional side view of another embodiment of the lamp shroud assembly and door of the present invention.

FIG. 6 illustrates another embodiment of the luminaire of the present invention, in which the external adjustment member 130 with its elongated shaft 131 is part of a turnbuckle assembly associated with another embodiment of the internal mechanism which includes a non-movable nut 132 rigidly connected to turnbuckle bar 134. The shaft 131 of the external adjustment member 130 is rotatably secured to the shroud 14 by securing means 133. Turnbuckle pin 136 pivotally connects the turnbuckle bar 134 to the lamp socket 18. In use, screwing and unscrewing of the shaft 131 via member 130 causes the internal mechanism to laterally move the lamp socket 18 and lamp 20. Typically, the lens end of the lamp 20 is fixed in position proximate the opening 16 of the shroud 14. More specifically, as member 130 is turned, the elongated shaft 131 is screwed into or out of the non-movable nut 132 (depending on which direction the member 130 is turned), causing the turnbuckle bar 134 to laterally push or pull the lamp socket 18. Thus, as the lamp 20 is moved by the turning of the external adjustment member 130 from a first position in which light is aimed along line AA to a second position (shown in phantom) in which light is aimed along line BB, it can be positioned at any position along angle CC, so that the desired vertical direction of the light coming from the shroud is achieved. In the embodiment shown in FIG. 6, retaining clips 138 and 142 are located on either side of the lamp 20 in order to stabilize and fix the position of the lens end of the lamp. Support 140 anchors the retaining clips 138, 142 within the shroud 14.

In an alternative embodiment (not shown), the external adjustment member can be a simple handle and the internal mechanism can be a rod pivotally connected to the lamp socket at one end and linearly connected to the handle at another end, whereby pushing and pulling of the handle causes the internal mechanism to laterally pivot or move the lamp socket. With this embodiment, like the embodiment of FIG. 6, the linear movement of the internal mechanism caused by movement of the external adjustment member is equivalent to the angular movement of the lamp socket, providing no mechanical advantage.

In the various embodiments of the present invention, the lamp socket 18 and the lamp 20 are typically directed toward the opening 16 of the shroud 14, and the opening 16 is typically not perpendicular to the support structure. However, embodiments of the luminaire are envisioned in which the opening is perpendicular to the support structure. Assuming that the support structure is typically parallel with the ground so that a vertical line passing from support to the ground is an angle of 0°, then the angle of the line 100, which corresponds to the axis of the shroud 14, is typically at an angle from about 10° to about 80° from vertical, more typically about 30° to 60°. The external adjustment means of the present invention further allows the line 200 of light emitted from lamp 20 to be altered at an angle θ from line 100. Typically the angle θ can be altered by a user from between about −35° to about +35°, more typically from between about −20° to about +20°, relative to the axis 100 of the shroud. Further, the shroud 14 can be rotated up to 360° within the door frame 12. The rim edge 28 of the shroud 14 is typically formed with a projection to limit rotation of the shroud 14 within the door frame 12 to a single revolution. Still further, the opening of the shroud 14 can be covered by a lens.

While the present invention has been illustrated by description of several embodiments which have been described in detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and method, and illustrative examples shown and described. Accordingly, departures may be made from the details without departing from the spirit or scope of applicant's general inventive concept.

What is claimed is:

1. An adjustment mechanism for directing the emitted light from a lamp of a luminaire, the luminaire comprising a luminaire support structure; a door frame attached to the structure; a lamp shroud assembly comprising a shroud rotatably attached to the door frame and having an opening, and a lamp socket sized to receive the base of a replaceable lamp and electrically connectable to an electric power source, the adjustment mechanism comprising:

a. a movable external adjustment member; and b. an internal mechanism attached to the external adjustment member though the shroud and indirectly connected to a portion of the lamp socket, the internal mechanism being movable in response to movement of the external adjustment member, wherein movement of the external adjustment member alters the position of the lamp socket within the shroud, wherein the angle of direction of light emitted from the replaceable lamp through the opening of the shroud is adjusted.

2. The adjustment mechanism of claim 1, wherein the internal mechanism comprises:

a. a non-rotatable adjustment brace to receive the external adjustment member;

b. a lever connected to the non-rotatable adjustment brace by a brace pin;

c. a fulcrum mounted on the inner wall of the shroud and connected to the lever by a fulcrum pin;

d. at least one mounting bracket connected to the lever by a bracket pin;

e. a directional lamp harness mounted to the lamp socket and connected to the at least one mounting bracket by a bracket connector; and f. an internal support base mounted proximate the opening of the shroud and connected to the directional harness by a harness connector.

3. The adjustment mechanism of claim 1, wherein the external adjustment member comprises a threaded member rotatably received by a portion of the internal mechanism, whereby rotation of the external adjustment member is operable to cause the internal mechanism to move the lamp socket with a mechanical advantage.

4. The adjustment mechanism of claim 1, wherein the external adjustment member comprises a turnbuckle assembly, whereby screwing and unscrewing of the external adjustment member is operable to cause the internal mechanism to move the lamp socket.

5. The adjustment mechanism of claim 1, wherein the external adjustment member comprises a handle and the internal mechanism comprises a rod connected to the handle at a first end and pivotally connected to the lamp socket at a second end, whereby pushing and pulling of the handle causes the internal mechanism to move the lamp socket.

6. An externally adjustable directional luminaire, comprising:

a. a luminaire support structure;

b. a door frame attached to the structure;

c. a lamp shroud assembly comprising a shroud rotatably attached to the door frame and having an opening, and a lamp socket sized to receive the base of a replaceable lamp and electrically connectable to an electric power source;

d. an external adjustment member located on the outside surface of the shroud; and e. an internal mechanism movably connected to the external adjustment member through the shroud at one end and connected to the lamp socket at another end, the internal mechanism being movable in response to movement of the external adjustment member, wherein movement of the external adjustment member alters the position of the lamp socket within the shroud, wherein the angle of direction of light emitted from the replaceable lamp through the opening of the shroud is adjusted.

7. The luminaire of claim 6, wherein the internal mechanism comprises:

f. a non-rotatable adjustment brace to receive the external adjustment member;

g. a lever connected to the non-rotatable adjustment brace by a brace pin;

h. a fulcrum mounted on the inner wall of the shroud and connected to the lever by a fulcrum pin;

i. at least one mounting bracket connected to the lever by a bracket pin;

j. a directional lamp harness mounted to the light supporting means and connected to the at least one mounting bracket by a bracket connector; and k. an internal support base mounted proximate the opening of the shroud and connected to the directional harness by a harness connector.

8. The luminaire of claim 7, wherein the lamp is held in position by a spring extending between the fulcrum and the lamp harness.

9. The luminaire of claim 6, wherein the external adjustment member comprises a threaded member rotatably received by a portion of the internal mechanism, whereby rotation of the external adjustment member is operable to cause the internal mechanism to move the lamp socket with a mechanical advantage.

10. The luminaire of claim 6, wherein the external adjustment member comprises a turnbuckle assembly, whereby screwing and unscrewing of the external adjustment member is operable to cause the internal mechanism to move the lamp socket.

11. The luminaire of claim 6, wherein the external adjustment member comprises a handle and the internal mechanism comprises a rod connected to the handle at a first end and pivotally connected to the lamp socket at a second end, whereby pushing and pulling of the handle causes the internal mechanism to move the lamp socket.

12. The luminaire of claim 6, wherein the opening is covered by a lens.

13. The luminaire of claim 6, wherein the door frame includes a retaining lip formed with a recessed groove to receive a rim edge of the shroud, which is formed with a groove of substantially similar dimensions to that of the door frame.

14. The luminaire of claim 13, wherein the groove of the rim edge is formed with a projection to limit rotation of the shroud within the door frame to a single revolution.

15. The luminaire of claim 14, further comprising one or more clamping mechanisms comprising a top clamp portion contacting the rim edge of the shroud and a bottom portion comprising a screw extending from beneath the door frame through a clearance opening in the threaded opening in the top clamp portion, wherein upon tightening of the screw, the clamping mechanisms presses the shroud and the door frame together and restricts movement of the coupled shroud and door frame.

16. The luminaire of claim 6, wherein the lamp socket and the lamp are directed toward the opening, the opening is not perpendicular to the structure, the groove of the rim edge is formed with a projection to limit rotation of the shroud within the door frame to a single revolution, and the opening is covered by a lens.

17. The luminaire of claim 6, wherein one side of the door frame is attached to the structure with at least one hinge and the opposite side of the door frame is attached to the structure with a flexible clamp mechanism.

* * * * *

UNITED STATES PATENT AND TRADEMARK OFFICE

CERTIFICATE OF CORRECTION

PATENT NO. : 7,517,119 B2
APPLICATION NO. : 11/560132
DATED : April 14, 2009
INVENTOR(S) : Robert E. Kaeser et al.

It is certified that error appears in the above-identified patent and that said Letters Patent is hereby corrected as shown below:

Column 5, line 27, delete “docs” and insert --does--.

Column 1, line 24, delete “though” and insert --through--.

Signed and Sealed this

Ninth Day of June, 2009

JOHN DOLL
*Acting Director of the United States Patent and Trademark Office*